US006762743B2

(12) United States Patent
Yoshihara et al.

(10) Patent No.: US 6,762,743 B2
(45) Date of Patent: Jul. 13, 2004

(54) DISPLAY DEVICE EMPLOYING A FIELD-SEQUENTIAL METHOD

(75) Inventors: Toshiaki Yoshihara, Kawasaki (JP); Keiichi Betsui, Kawasaki (JP); Tetsuya Makino, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 20 days.

(21) Appl. No.: 10/024,846

(22) Filed: Dec. 18, 2001

(65) Prior Publication Data

US 2003/0010894 A1 Jan. 16, 2003

(30) Foreign Application Priority Data

Jul. 16, 2001 (JP) ..... 2001-215741

(51) Int. Cl.[7] ..... G09G 3/36
(52) U.S. Cl. ..... 345/102; 345/97
(58) Field of Search ..... 250/208.1, 205, 250/206, 214 R, 226, 214 LS, 214 D; 348/332, 742, 206, 521, 503, 455, 441, 459, 793; 345/593, 591, 10–12, 20, 22, 87–89, 101, 103, 213, 690–691; 353/46, 52; 362/510–511, 11, 13, 18, 2; 359/238, 240, 267, 298, 310

(56) References Cited

U.S. PATENT DOCUMENTS 4,611,889 A * 9/1986 Buzak ..... 349/69
5,717,422 A * 2/1998 Fergason ..... 345/102
5,737,036 A * 4/1998 Kanai et al. ..... 348/742
5,844,534 A * 12/1998 Okumura et al. ..... 345/90
5,844,538 A * 12/1998 Shiraki et al. ..... 345/98
6,094,243 A * 7/2000 Yasunishi ..... 349/33
6,115,021 A * 9/2000 Nonomura et al. ..... 345/101
6,379,011 B1 * 4/2002 Knox ..... 353/31

* cited by examiner

*Primary Examiner*—David Porta
*Assistant Examiner*—Patrick J. Lee
(74) *Attorney, Agent, or Firm*—Greer, Burns & Crain, Ltd.

(57) ABSTRACT

In a display device employing a field-sequential method, a judgement whether display data is motion picture data or still picture data is made, and the frame number per second is increased for the display of a motion picture during which color break easily occurs by the movement of the line of sight of a user, while the frame number is made smaller than that for the display of a motion picture, for the display of a still picture during which color break hardly occurs. Further, the temperature of a liquid crystal panel is detected, and the frame number per second is increased so as to reduce color break when the result of the detection is not lower than a predetermined temperature, while, the frame number is decreased so as to enable display at low temperature when the result of the detection is lower than the predetermined temperature.

7 Claims, 12 Drawing Sheets

DD
MOTION PICTURE / STILL PICTURE DISCRIMINATION CIRCUIT
61
FRAME NUMBER CHANGING CIRCUIT
60
SYN
DD
CONTROL SIGNAL GENERATION CIRCUIT
31
IMAGE MEMORY
30
PD
DCS
36
CS
REFERENCE VOLTAGE GENERATION CIRCUIT
34
VR1
VR2
DATA DRIVER
32
21
22
LIQUID CRYSTAL PANEL
R G B BACK-LIGHT
SCAN DRIVER
33
BACK-LIGHT CONTROL CIRCUIT
35

DISPLAY DEVICE EMPLOYING A FIELD-SEQUENTIAL METHOD

BACKGROUND OF THE INVENTION

The present invention relates to a display device employing a field-sequential method for displaying a color image by synchronizing the light-emission timing of each color of emitted light and the switching of a light switching element for controlling the intensity of light for display.

Along with the recent development of so-called information-oriented society, electronic apparatuses, such as personal computers and PDA (Personal Digital Assistants), have been widely used. Further, with the spread of such electronic apparatuses, portable apparatuses that can be used in offices as well as outdoors have been used, and there are demands for small-size and light-weight of these apparatuses. Liquid crystal display devices have been widely used as one of the means to satisfy such demands. Liquid crystal display devices not only achieve small size and light weight, but also include an indispensable technique in an attempt to achieve low power consumption in portable electronic apparatuses that are driven by batteries.

By the way, the liquid crystal display devices are mainly classified into the reflection type and the transmission type. In the reflection type liquid crystal display devices, light rays incident from the front face of a liquid crystal panel are reflected by the rear face of the liquid crystal panel, and an image is visualized by the reflected light; whereas in the transmission type liquid crystal display devices, the image is visualized by the transmitted light from a light source (back-light) provided on the rear face of the liquid crystal panel. Since the reflection type liquid crystal display devices have poor visibility resulting from the reflected light amount that varies depending on environmental conditions, transmission type liquid crystal display devices are generally used as display devices of, particularly, personal computers displaying a multi-color or full-color image.

In addition, the current color liquid crystal display devices are generally classified into the STN (Super Twisted Nematic) type and the TFT-TN (Thin Film Transistor-Twisted Nematic) type, based on the liquid crystal materials to be used. The STN type liquid crystal display devices have comparatively low production costs, but they are not suitable for the display of a motion image because they are susceptible to crosstalk and comparatively slow in the response speed. In contrast, the TFT-TN type liquid crystal display devices have better display quality than the STN type, but they require a back-light with high intensity because the light transmittance of the liquid crystal panel is only 4% or so at present. For this reason, in the TFT-TN type liquid crystal display devices, a lot of power is consumed by the back-light, and there would be a problem when used with a portable battery power source. Moreover, the TFT-TN type liquid crystal display devices have other problems including a low response speed, particularly, in displaying half tones, a narrow viewing angle, and a difficult color balance adjustment.

Therefore, in order to solve the above problems, the present inventors et al. are carrying out the development of liquid crystal display devices using ferroelectric liquid crystals or antiferroelectric liquid crystals having spontaneous polarization and a high response speed of several hundreds to several $\mu$s order with respect to an applied voltage. When a liquid crystal material having spontaneous polarization, such as ferroelectric liquid crystal and antiferroelectric liquid crystal, is used as the liquid crystal material, the liquid crystal molecules are always parallel to the substrate irrespective of the presence or absence of applied voltage, and the change in the refraction factor in the viewing direction is much smaller compared with the conventional STN type and TN type. It is thus possible to obtain a wide viewing angle.

Furthermore, the present inventors et al. who are carrying out the research of a liquid crystal display device that drives such a liquid crystal material having spontaneous polarization by a switching element such as a TFT have developed a liquid crystal display device employing a field-sequential method, which uses ferroelectric liquid crystal elements or antiferroelectric liquid crystal elements having a high response speed to an applied electric field as the liquid crystal elements and displays a color image by causing a single pixel to emit light of three primary colors in a time-divided manner. Such a liquid crystal display device realizes a color display by combining a liquid crystal panel using ferroelectric liquid crystal elements or antiferroelectric liquid crystal elements capable of responding at a high speed of several hundreds to several $\mu$s order with a back-light capable of emitting red, green and blue lights in a time-divided manner and by synchronizing the switching of the liquid crystal element with the light emission of the back-light, more specifically, by dividing one frame into three sub-frames and causing a red LED, a green LED and a blue LED to emit light in the first sub-frame, the second sub-frame and the third sub-frame, respectively.

A display device employing a field-sequential method as described above can easily display a more definite image compared with a display device employing a color-filter method, and has advantages such as high brightness, excellent purity of display color, high light utilization efficiency and low power consumption because it uses the light emission of the light source as it is for display without using a color filter. In the display device employing a field-sequential method, however, since an image is displayed by switching the colors of light emitted by the light source, such as red, green and blue, the images of three colors having a time difference are not superimposed on the same point on the retina of a human when he/she moves the line of sight, and therefore there is a problem of occurrence of a phenomenon called "color break" in which a display color different from the original image is momentarily recognized.

BRIEF SUMMARY OF THE INVENTION

A principal object of the present invention is to provide a display device employing a field-sequential method, capable of reducing color break without considerably changing the power consumption and the displayable temperature range.

A display device of the first aspect is a display device employing a field-sequential method for displaying a color image by sequentially switching a plurality of colors of emitted light of a light source within one frame and by synchronizing a light-emission timing of each color of emitted light with a switching of a light switching element for controlling an intensity of light for display, and comprises changing means for changing a frame number per unit time.

According to the first aspect, a reduction of color break is achieved by changing the frame number per unit time in displaying a color image by synchronizing the light-emission timing of the color of emitted light with the switching of the light switching element for controlling the intensity of light for display. Color break is caused by the movement of the line of sight of the user and the time-lapse display of display colors. Therefore, by shortening the switching time of the color of emitted light, i.e., by increasing the frame number per unit time, it is possible to reduce color break. However, when a reduction of color break is made in such a manner, problems arise that the displayable temperature range is narrowed and the power consumption increases with an increase of the frame number. Then, in the first aspect, by changing the frame number per unit time according to a condition, i.e., by increasing the frame number when color break is noticeable or decreasing the frame number when color break is not noticeable, a reduction of color break is achieved without considerably changing the displayable temperature range and the power consumption.

A display device of the second aspect is based on the first aspect, wherein the changing means comprises discriminating means for judging whether display data is motion picture data or still picture data, and means for changing the frame number per unit time based on the result of the judgement by the discriminating means.

According to the second aspect, the frame number is changed based on the type of display data (motion picture data or still picture data). In displaying a motion image in which the user moves the line of sight, color break occurs noticeably. Therefore, by changing the frame number in displaying a motion image and in displaying a still image, it is possible to reduce color break efficiently according to the type of the display data.

A display device of the third aspect is based on the second aspect, wherein, when the display data is motion picture data, the frame number per unit time is increased compared with the frame number for still picture data.

In the third aspect, the frame number is increased for the display of a motion image during which color break easily occurs, while the frame number is made smaller than that for the display of a motion image for the display of a still image during which color break hardly occurs. Accordingly, it is possible to reduce color break without causing a significant increase in the power consumption A display device of the fourth aspect is based on the first aspect, wherein the changing means comprises detecting means for detecting the temperature of the light switching element, and means for changing the frame number per unit time based on the result of the detection by the detecting means.

In the fourth aspect, the frame number is changed based on the temperature of the light switching element. When the frame number is increased so as to reduce color break, the time of each sub-frame is shortened, and therefore, if a liquid crystal display element is used as the light switching element, the responsiveness of the liquid crystal is lowered due to an increase in the viscosity of the liquid crystal caused by a decrease of the temperature although the liquid crystal is required to have a fast responsiveness. For this reason, when the frame number is increased, in general, it becomes difficult to display an image on a low-temperature side, resulting in a narrower displayable temperature range. Therefore, by changing the frame number for a high temperature state or for a low temperature state, it is possible to reduce color break efficiently according to the temperature state.

A display device of the fifth aspect is based on the fourth aspect, wherein, when the temperature of the light switching element is higher than a predetermined temperature, the frame number per unit time is increased compared with the frame number for a temperature lower than the predetermined temperature.

In the fifth aspect, at high temperature at which there is no possibility of display difficulty, the frame number is increased so as to reduce color break, while at low temperature at which there is a possibility of display difficulty, the frame number is decreased so as to enable display that has priority over the reduction of color break. Accordingly, it is possible to achieve both the reduction of color break at a frequently used high-temperature range and the retention of the displayable temperature range, thereby reducing color break without narrowing the displayable temperature range.

A display device of the sixth aspect is based on any one of the first through fifth aspects, wherein the light switching element is a liquid crystal display element.

In accordance with the sixth aspect, a liquid crystal display element is used as the light switching element, and it is possible to reduce color break in the liquid crystal display.

A display device of the seventh aspect is based on the sixth aspect, wherein the liquid crystal display element includes a liquid crystal material having spontaneous polarization.

In accordance with the seventh aspect, since a liquid crystal material having spontaneous polarization is used in the liquid crystal element, it is possible to obtain a wide viewing angle.

A display device of the eighth aspect is based on the sixth or seventh aspect, wherein the liquid crystal display element comprises an active element corresponding to each of a plurality of liquid crystal pixels.

In accordance with the eighth aspect, in the liquid crystal display element, since each of a plurality of liquid crystal pixels is independently controlled and driven by the active element, it is possible to obtain high display characteristics.

The above and further objects and features of the invention will more fully be apparent from the following detailed description with accompanying drawings.

DETAILED DESCRIPTION OF THE INVENTION

The following description will specifically explain the present invention with reference to the drawings illustrating some embodiments thereof. It should be noted that the present invention is not limited to the following embodiments.

(First Embodiment)

Figure 1:
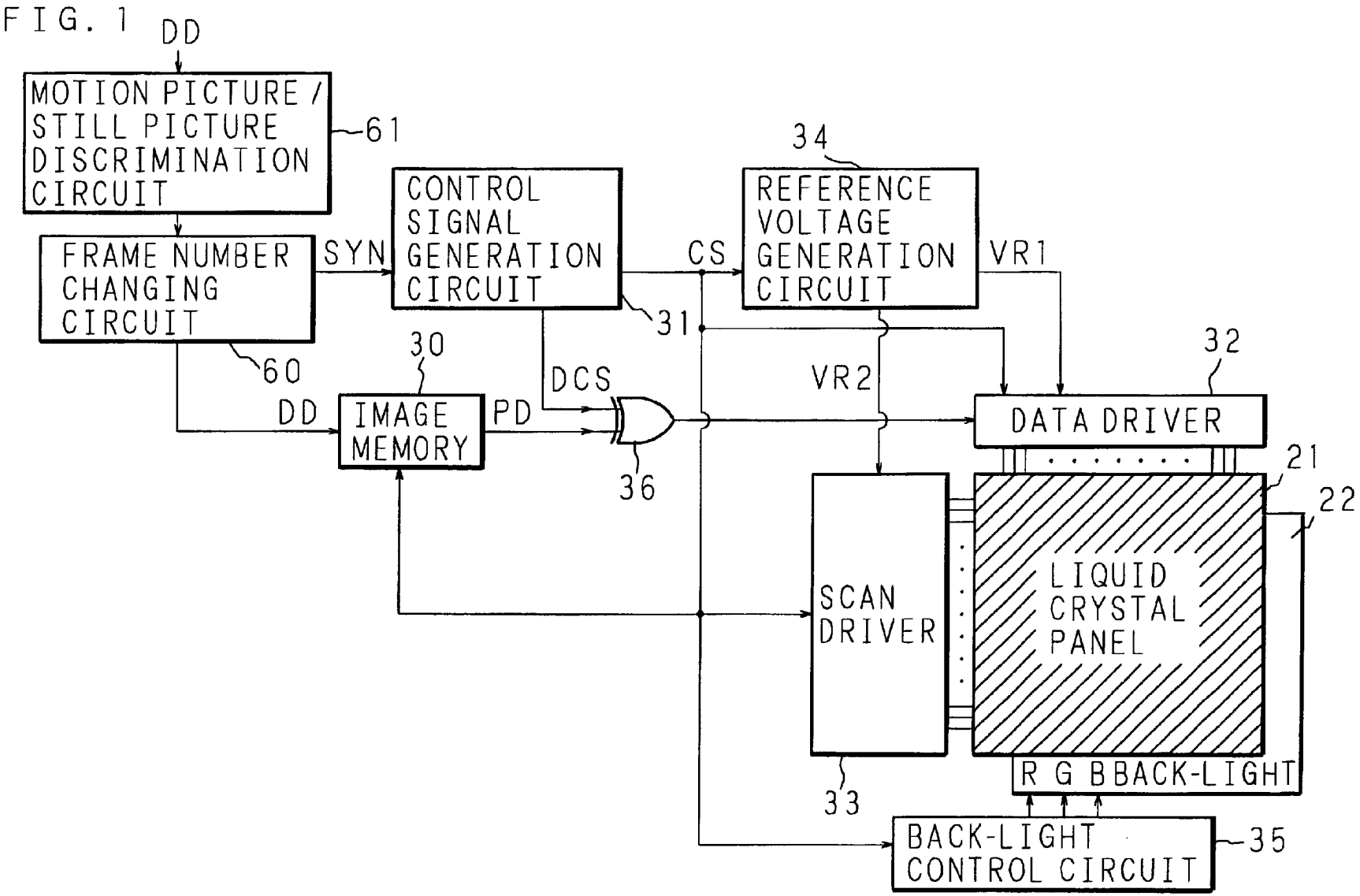
FIG. 1 is a block diagram showing the circuit structure of a liquid crystal display device according to the first embodiment.
Figure 2:
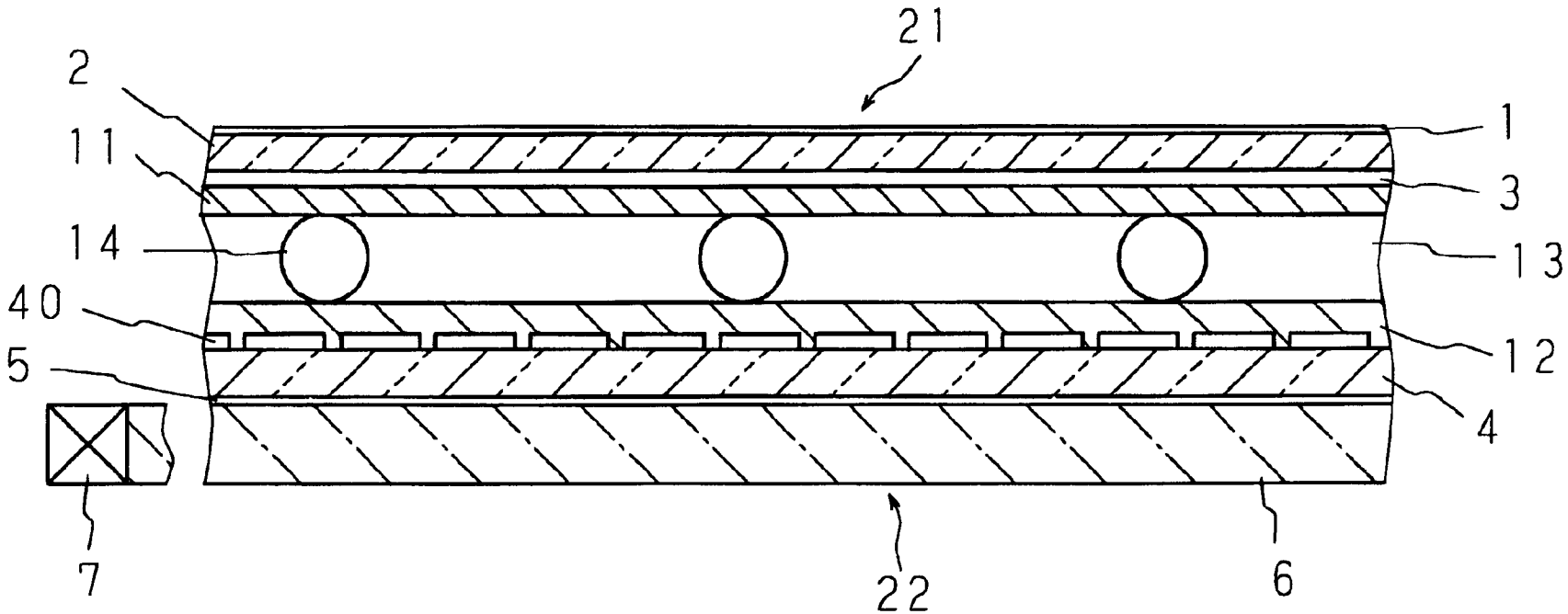
FIG. 2 is a schematic cross sectional view of a liquid crystal panel and a back-light.
Figure 3:
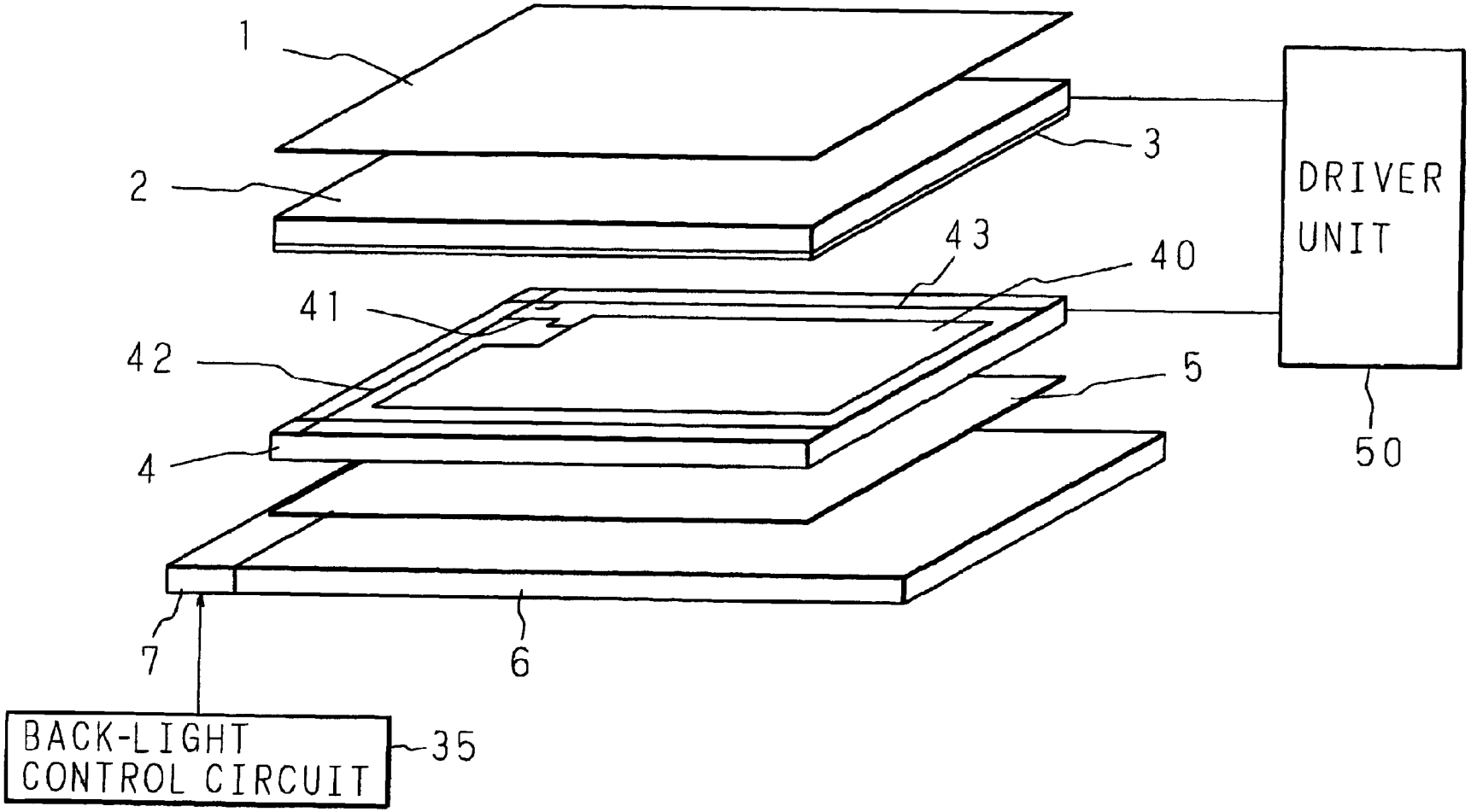
FIG. 3 is a schematic view showing an example of the entire structure of the liquid crystal display device.
Figure 4:
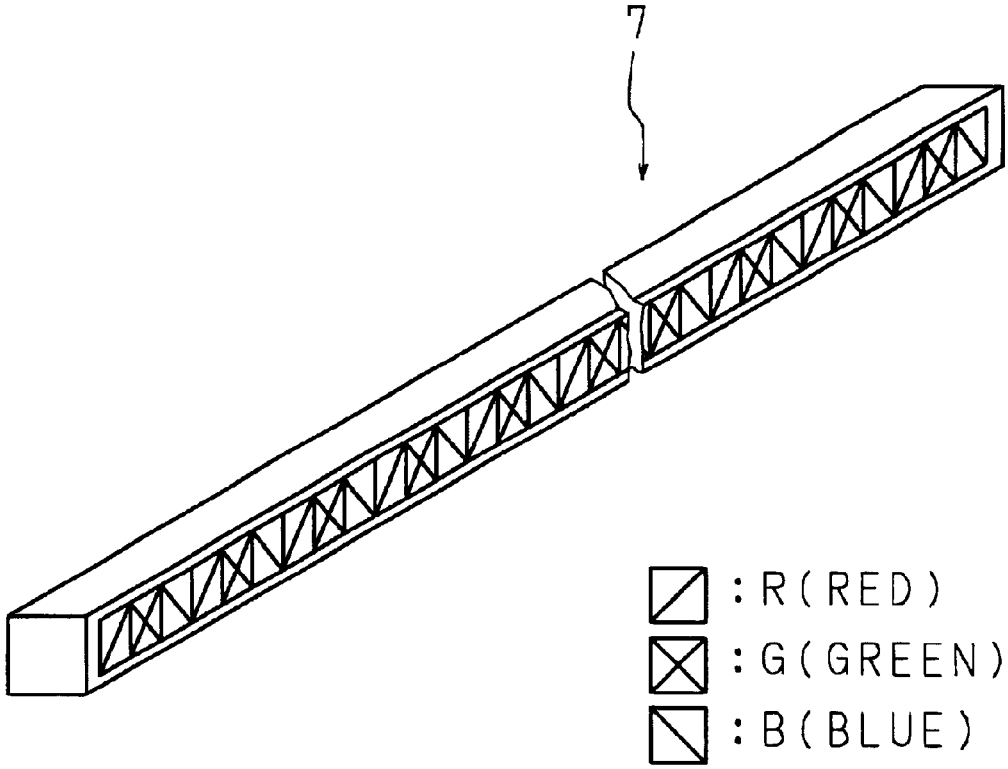
FIG. 4 is a view showing an example of the structure of an LED array.

FIG. 1 is a block diagram showing the circuit structure of a liquid crystal display device according to the first embodiment, FIG. 2 is a schematic cross sectional view of the liquid crystal panel and back-light, FIG. 3 is a schematic view showing an example of the entire structure of the liquid crystal display device, and FIG. 4 is a view showing an example of the structure of an LED array as a light source of the back-light.

As shown in FIGS. 2 and 3, a liquid crystal panel 21 is constituted by a polarization film 1, a glass substrate 2, a common electrode 3, a glass substrate 4 and a polarization film 5, which are stacked in this order from the upper layer (surface) side to the lower layer (rear face) side, and pixel electrodes 40 arranged in a matrix form are formed on the common electrode 3 side of the glass substrate 4.

A driver unit 50 which is formed by a data driver 32, a scan driver 33, etc. as to be described later is connected between the common electrode 3 and the pixel electrodes 40. The data driver 32 is connected to a TFT (Thin Film Transistor) 41 through a signal line 42, while the scan driver 33 is connected to the TFT 41 through a scanning line 43. The TFT 41 is controlled to be on/off by the scan driver 33. Each pixel electrode 40 is controlled to be on/off by the TFT 41. Therefore, the intensity of transmitted light of each pixel is controlled by a signal given from the data driver 32 through the signal line 42 and the TFT 41.

An alignment film 12 is provided on the upper face of the pixel electrodes 40 on the glass substrate 4 and an alignment film 11 is placed on the lower face of the common electrode 3, and a liquid crystal layer 13 is formed by filling the space between the alignment films 11 and 12 with a liquid crystal material. Further, 14 represents spacers for maintaining a layer thickness of the liquid crystal layer 13.

A back-light 22 is disposed on the lower layer (rear face) side of the liquid crystal panel 21, and comprises an LED array 7 placed to face an end face of a light guiding and diffusing plate 6 forming a light emitting area. As shown in FIG. 4, this LED array 7 comprises LEDs for emitting light of three primary colors, i.e., red (R), green (G) and blue (B), which are sequentially and repeatedly arranged on a surface facing the light guiding and diffusing plate 6. Further, the red, green and blue LEDs are controlled to emit light in red, green and blue sub-frames, respectively, according to a later-described field-sequential method. The light guiding and diffusing plate 6 guides light emitted from each LED to its entire surface and diffuses it toward the upper face, thereby functioning as the light emitting area.

Here, a specific example of the liquid crystal panel 21 will be explained. First, the liquid crystal panel 21 shown in FIGS. 2 and 3 was fabricated as follows. After washing the TFT substrate having the pixel electrodes 40 (640×480 pixels arranged in a matrix form with a diagonal of 3.2 inches) and the glass substrate 2 having the common electrode 3, they were coated with polyamide and then baked for one hour at 200° C. so as to form about 200 Å thick polyimide films as the alignment films 11 and 12.

Furthermore, these alignment films 11 and 12 were rubbed with a rayon fabric, and stacked with a gap being maintained therebetween by the spacers 14 made of silica having an average particle size of 1.6 $\mu$m so as to fabricate an empty panel. A ferroelectric liquid crystal material composed mainly of naphthalene-based liquid crystals and having spontaneous polarization was sealed in between the alignment films 11 and 12 of this empty panel so as to form the liquid crystal layer 13. The magnitude of spontaneous polarization of the sealed ferroelectric liquid crystal material was 6 nC/cm$^2$. The fabricated panel was sandwiched by two polarization films 1 and 5 maintained in a crossed-Nicol state so that a dark state was produced when the ferroelectric liquid crystal molecules in the liquid crystal layer 13 titled to one direction, thereby forming the liquid crystal panel 21.

In FIG. 1, reference numeral 61 represents a motion picture/still picture discrimination circuit to which image data DD to be displayed is inputted from an external device, and which judges whether the inputted image data DD is motion picture data or still picture data and outputs the result of the judgement to a frame number changing circuit 60. The frame number changing circuit 60 changes the frame number per second to a larger number when the motion picture/still picture discrimination circuit 61 judges that the image data DD is motion picture data, while it changes the frame number per second to a smaller number when the image data DD is judged still picture data, and then the frame number changing circuit 60 outputs a synchronous signal SYN according to each of the set frame numbers to a control signal generation circuit 31.

The control signal generation circuit 31 generates a control signal CS and a data conversion control signal DCS based on the inputted synchronous signal SYN. Pixel data PD is outputted from an image memory 30 to a data conversion circuit 36, and the data conversion control signal DCS is also outputted thereto from the control signal generation circuit 31. The data conversion circuit 36 generates inverted pixel data #PD by inverting the inputted pixel data PD in accordance with the data conversion control signal DCS.

Moreover, the control signal CS is outputted from the control signal generation circuit 31 to each of a reference voltage generation circuit 34, data driver 32, scan driver 33, and back-light control circuit 35. The reference voltage generation circuit 34 generates reference voltages VR1 and VR2, and outputs the generated reference voltages VR1 and VR2 to the data driver 32 and the scan driver 33, respectively. The data driver 32 outputs a signal to the signal lines 42 of the pixel electrodes 40 based on the pixel data PD or inverted pixel data #PD received from the image memory 30 through the data conversion circuit 36. In synchronism with the output of this signal, the scan driver 33 scans sequentially the scanning lines 43 of the pixel electrodes 40 on a line by line basis. Furthermore, the back-light control circuit 35 applies a drive voltage to the back-light 22 so that the red, green and blue LEDs of the LED array 7 of the back-light 22 emit light in a time-divided manner.

Next, the operation of the liquid crystal display device according to the present invention will be explained. When the image data DD to be displayed is inputted from an external device to the motion picture/still picture discrimination circuit 61, a judgement whether the image data is motion picture data or still picture data is made, and the result of the judgement is outputted to the frame number changing circuit 60. Then, when the image data DD is motion picture data, a large frame number is set for one second, while, when the image data DD is still picture data, a small frame number is set for one second.

After temporarily storing the image data DD, the image memory 30 outputs the pixel data PD that is data of each pixel unit upon receipt of the control signal CS outputted from the control signal generation circuit 31. When the display data DD is supplied to the image memory 30, the synchronous signal SYN is fed to the control signal generation circuit 31. When the synchronous signal SYN is inputted, the control signal generation circuit 31 generates and outputs the control signal CS and data conversion control signal DCS. The pixel data PD outputted from the image memory 30 is supplied to the data conversion circuit 36.

When the data conversion control signal DCS outputted from the control signal generation circuit 31 has the L level, the data conversion circuit 36 passes the pixel data PD as it is, while, when the data conversion control signal DCS has the H level, the data conversion circuit 36 generates and outputs the inverted pixel data #PD. Thus, in the control signal generation circuit 31, the data conversion control signal DCS is set to be the L level in data-writing scanning, while it is set to be the H level in data-erasing scanning.

The control signal CS generated in the control signal generation circuit 31 is supplied to the data driver 32, scan driver 33, reference voltage generation circuit 34 and back-light control circuit 35. The reference voltage generation circuit 34 generates the reference voltages VR1 and VR2 upon receipt of the control signal CS, and outputs the generated reference voltages VR1 and VR2 to the data driver 32 and the scan driver 33, respectively.

Upon receipt of the control signal CS, the data driver 32 outputs a signal to the signal lines 42 of the pixel electrodes 40 based on the pixel data PD or the inverted pixel data #PD outputted from the image memory 30 through the data conversion circuit 36. Upon receipt of the control signal CS, the scan driver 33 sequentially scans the scanning lines 43 of the pixel electrodes 40 on a line by line basis. In accordance with the output of the signal from the data driver 32 and the scanning by the scan driver 33, the TFTs 41 are driven, a voltage is applied to the pixel electrodes 40 and the intensity of the transmitting light of the pixels is controlled.

Upon receipt of the control signal Cs, the back-light control circuit 35 applies a drive voltage to the back-light 22 so that the red, green and blue LEDs of the LED array 7 of the back-light 22 emit light in a time-divided manner.

Figure 5:
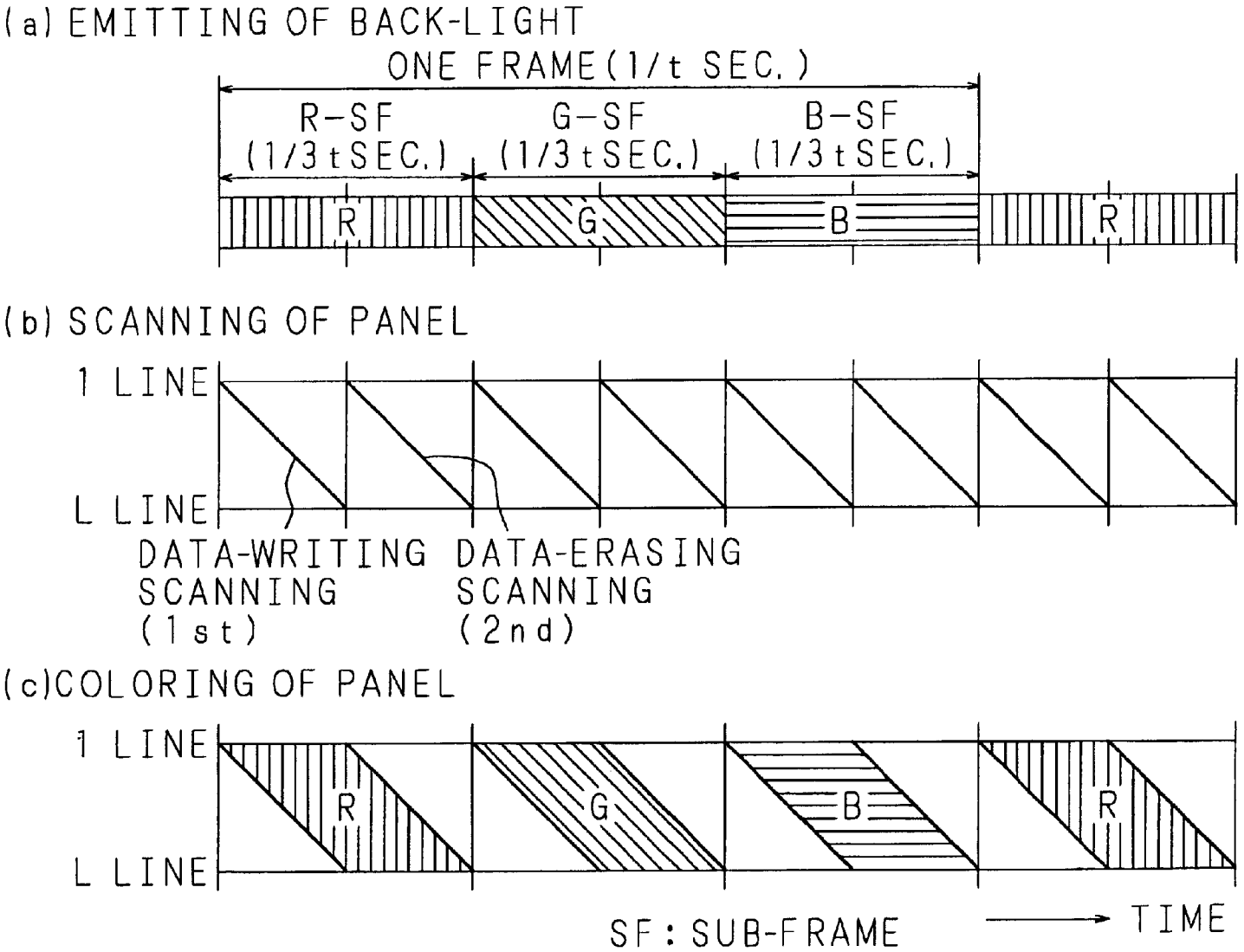
FIGS. 5(*a*), 5(*b*) and 5(*c*) show a time chart of display control in the liquid crystal display device.

In this liquid crystal display device, display control is performed according to the time chart shown in FIGS. 5(*a*), 5(*b*) and 5(*c*). FIG. 5(*a*) shows the light-emission timings of the LEDs of the respective colors of the back-light 22, FIG. 5(*b*) shows the scanning timing of each line of the liquid crystal panel 21, and FIG. 5(*c*) shows the coloring state of the liquid crystal panel 21. When the frame frequency is t hertz, t frames are displayed in one second. Accordingly, the period of one frame is 1/t second, and each of red, green and blue sub-frames obtained by dividing this one frame into three parts is 1/3t second.

Then, the red, green and blue LEDs are controlled to emit light sequentially in the first through third sub-frames, respectively, as shown in FIG. 5(*a*). By switching the pixels of the liquid crystal panel 21 on a line by line basis in synchronism with such a sequential emission of light of each color, a color image is displayed. Note that, in this example, while the red light, green light and blue light are emitted in the first sub-frame, the second sub-frame and the third sub-frame, respectively, the sequence of these colors is not necessarily limited to the red, green and blue order, and other sequence may be used.

Meanwhile, as shown in FIG. 5(*b*), with respect to the liquid crystal panel 21, data scanning is performed twice in each of the red, green and blue sub-frames. However, the timings are adjusted so that the first scanning (data-writing scanning) start timing (a timing to the first line) coincides with the start timing of each sub-frame and the second scanning (data-erasing scanning) end timing (a timing to the last line) coincides with the end timing of each sub-frame.

During the data-writing scanning, a voltage corresponding to the pixel data PD is applied to each pixel of the liquid crystal panel 21 so as to adjust the light-transmittance. Accordingly, it is possible to display a full-color image. Moreover, during the data-erasing scanning, a voltage which is the same as but has an opposite polarity to the voltage applied in the data-writing scanning is applied to each pixel of the liquid crystal panel 21 so as to erase the display of each pixel of the liquid crystal panel 21, thereby preventing an application of a direct-current component to the liquid crystal.

A color image is displayed by the field-sequential method in the above-described manner, and, in the first embodiment, a judgement whether the image data to be displayed is motion picture data or still picture data is made and the value of the frame frequency (frame number per second) t is changed based on the result of the judgement. More specifically, when the image data is motion picture data in which color break is easily recognized visually, the value of t is increased, while when the image data is still picture data in which color break is hardly recognized visually, the value of t is decreased. Accordingly, it is possible to efficiently reduce color break without causing a considerable increase in the power consumption.

First Embodiment:

EXAMPLE 1

Figure 6:
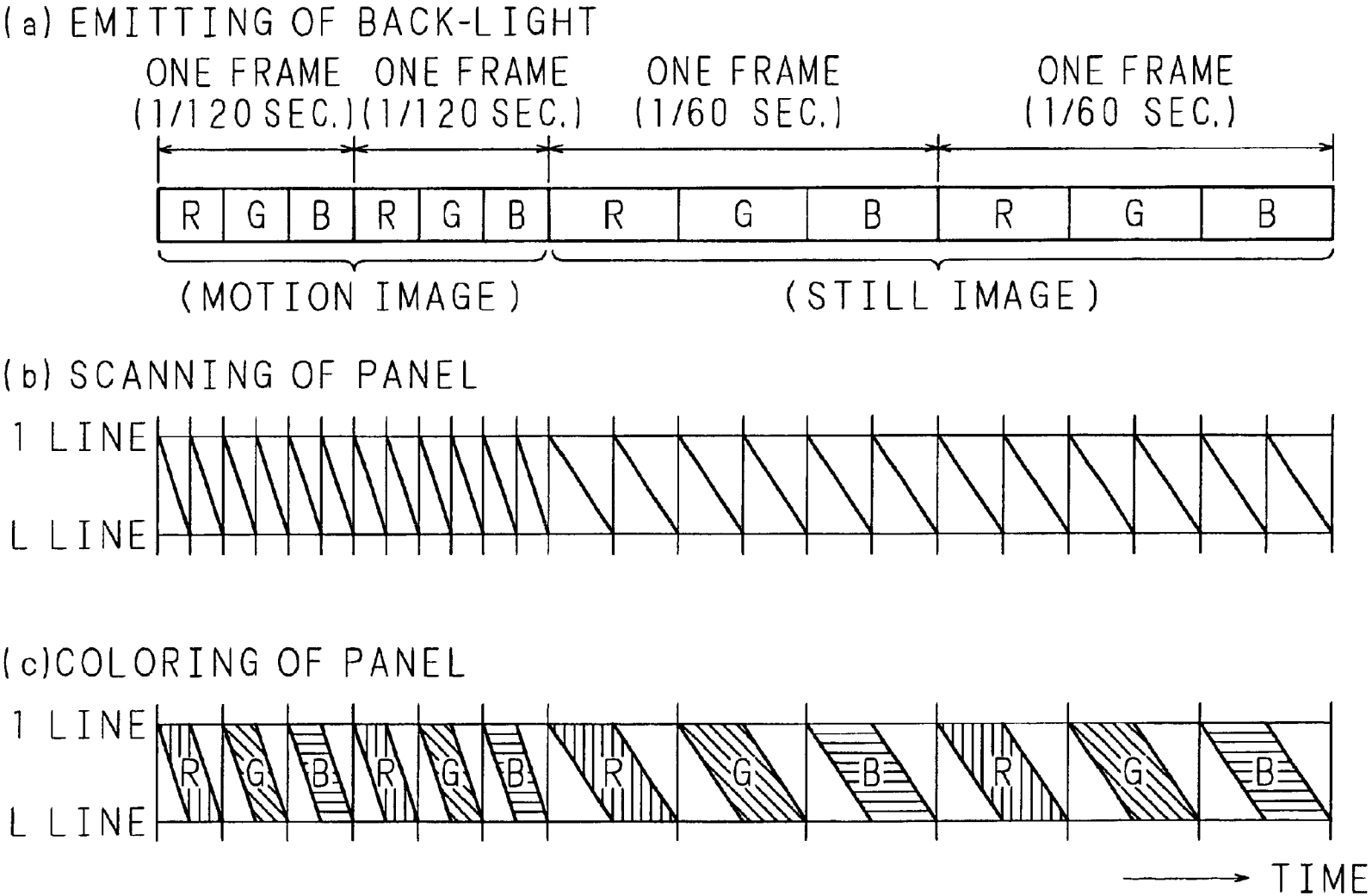
FIGS. 6(*a*), 6(*b*) and 6(*c*) show a time chart of display control according to Example 1.

FIGS. 6(*a*), 6(*b*) and 6(*c*) show the time chart of display control according to Example 1. In Example 1, a color image was displayed by changing the frame frequency to 120 hertz (t=120) for motion picture data and to 60 hertz (t=60) for still picture data. As a result, it was possible to reduce color break due to the movement of the line of sight. In this case, the power consumption of the liquid crystal panel 21 was about 400 mW.

First Embodiment:

EXAMPLE 2

Figure 7:
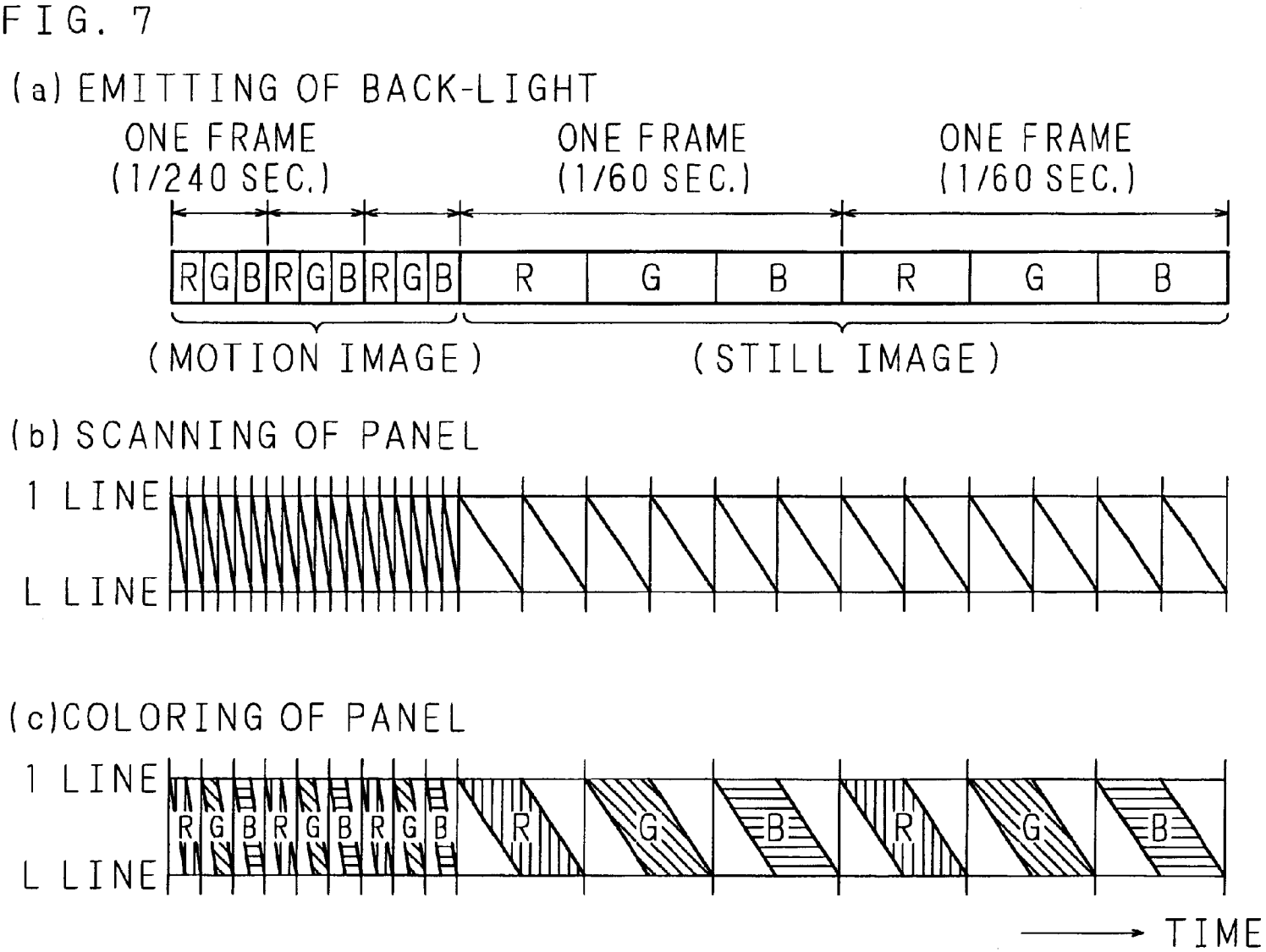
FIGS. 7(*a*), 7(*b*) and 7(*c*) show a time chart of display control according to Example 2.

FIGS. 7(*a*), 7(*b*) and 7(*c*) show the time chart of display control according to Example 2. In Example 2, a color image was displayed by changing the frame frequency to 240 hertz (t=240) for motion picture data and to 60 hertz (t=60) for still picture data. As a result, it was possible to further reduce color break due to the movement of the line of sight compared with Example 1, and no color break was recognized. In this case, the power consumption of the liquid crystal panel 21 was about 500 mW.

First Embodiment:

COMPARATIVE EXAMPLE 1

Figure 8:
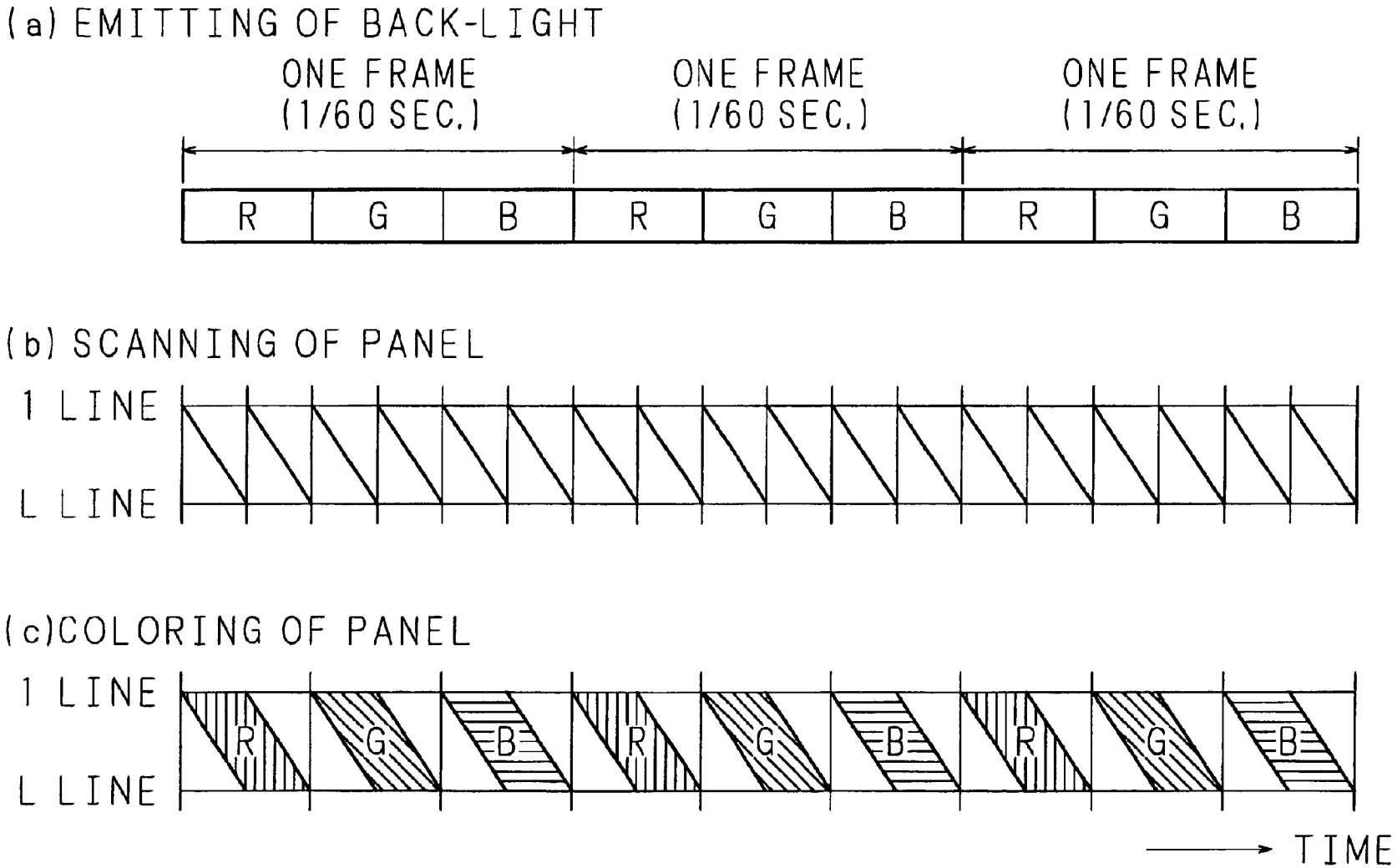
FIGS. 8(*a*), 8(*b*) and 8(*c*) show a time chart of display control according to Comparative Examples 1 and 3.

FIGS. 8(*a*), 8(*b*) and 8(*c*) show the time chart of display control according to Comparative Example 1. In Comparative Example 1, a color image was displayed by fixing the frame frequency at 60 hertz (t=60) irrespective of motion picture data and still picture data. As a result, color break due to the movement of the line of sight occurred. In this case, the power consumption of the liquid crystal panel 21 was about 350 mW.

First Embodiment:

COMPARATIVE EXAMPLE 2

Figure 9:
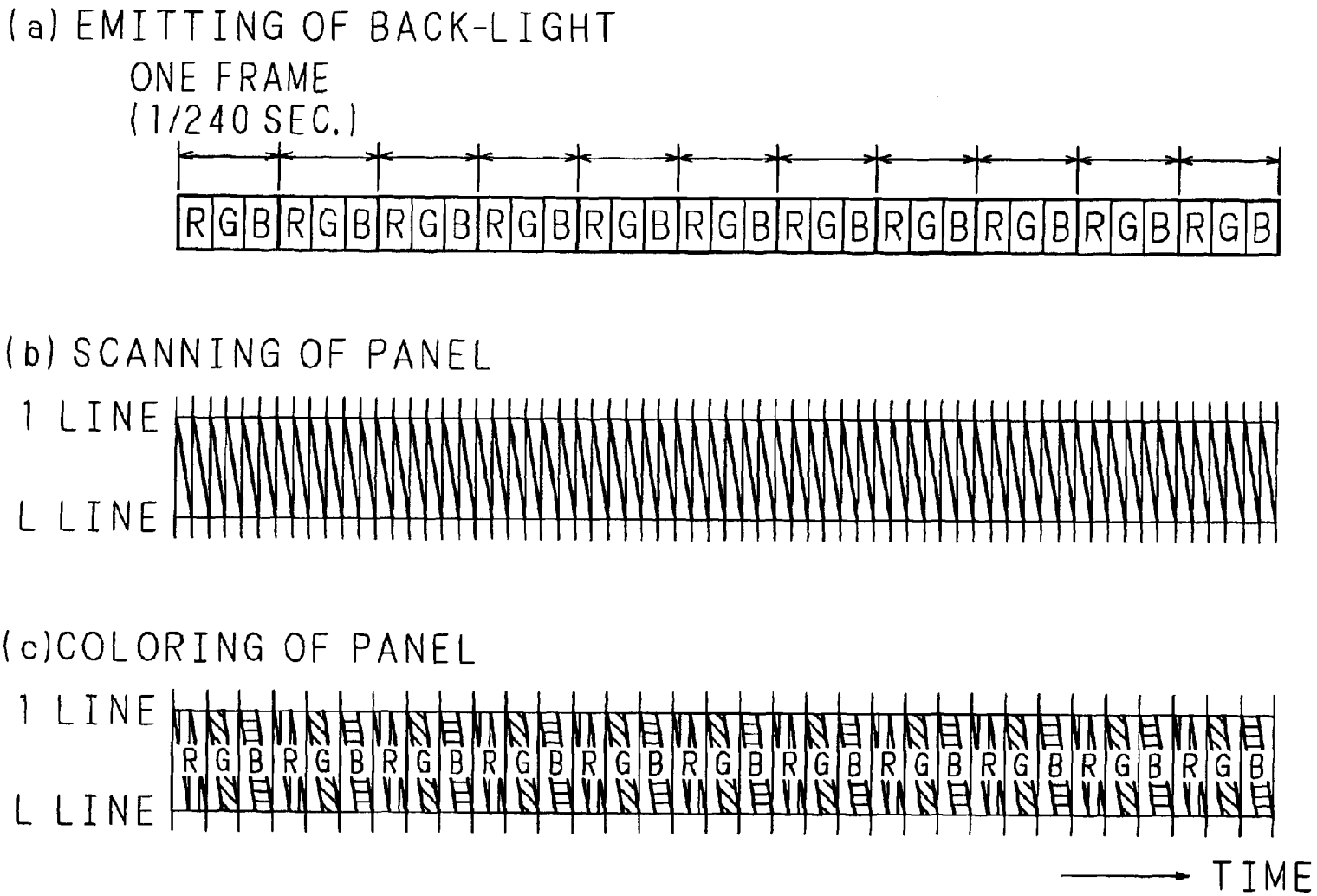
FIGS. 9(*a*), 9(*b*) and 9(*c*) show a time chart of display control according to Comparative Examples 2 and 4.

FIGS. 9(*a*), 9(*b*) and 9(*c*) show the time chart of display control according to Comparative Example 2. In Comparative Example 2, a color image was displayed by fixing the frame frequency at 240 hertz (t=240) irrespective of motion picture data and still picture data. As a result, it was possible to reduce color break due to the movement of the line of sight. In this case, however, the power consumption of the liquid crystal panel 21 was increased extremely to about 950 mW It can be understood by comparing Examples 1, 2 and Comparative Examples 1, 2 that the first embodiment can realize a reduction of color break without considerably increasing the power consumption.

(Second Embodiment)

Figure 10:
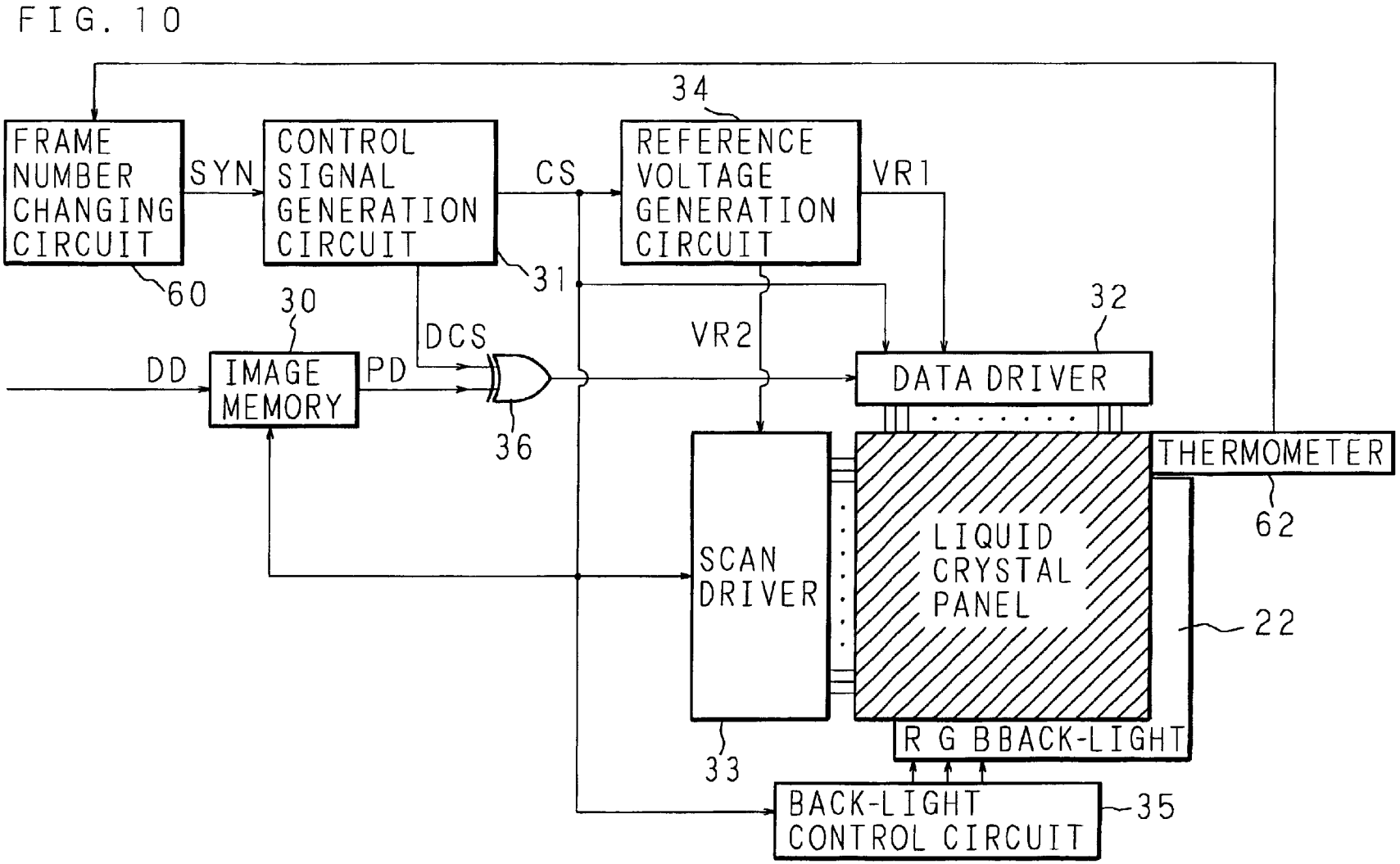
FIG. 10 is a block diagram showing the circuit structure of a liquid crystal display device according to the second embodiment.

FIG. 10 is a block diagram showing the circuit structure of a liquid crystal display device according to the second embodiment. In FIG. 10, the same parts as those in FIG. 1 are designated with the same numbers, and the explanation thereof is omitted. Besides, the structure of the liquid crystal panel and back-light of the second embodiment (see FIG. 2), the entire structure of the liquid crystal device (see FIG. 3) and the structure of the LED array as a light source of the back-light (see FIG. 4) are the same as those in the first embodiment.

In the second embodiment, the liquid crystal penal 21 is provided with a thermometer 62, and the thermometer 62 detects the temperature of the liquid crystal panel 21 and outputs the result of the detection to the frame number changing circuit 60. The frame number changing circuit 60 changes the frame number per second to a larger number when the result of the detection by the thermometer 62 is equal to or higher than a predetermined temperature, while it changes the frame number per second to a smaller number when the result of the detection is lower than the predetermined, and then the frame number changing circuit 60 outputs a synchronous signal SYN corresponding to each of the set frame numbers to the control signal generation circuit 31. More specifically, when the temperature of the liquid crystal panel 21 is equal to or higher than the predetermined temperature, the frame number per second (the value of t in the time chart shown in FIG. 5(*a*)) is increased, while, when the temperature is lower than the predetermined temperature, the frame number per second (the value of t in the time chart shown in FIG. 5(*a*)) is decreased.

The second embodiment displays a color image by a field-sequential method similar to the first embodiment, but detects the temperature of the liquid crystal panel 21 and changes the value of the frame frequency (frame number per second) t based on the result of the detection. More specifically, when the liquid crystal panel 21 is in a high-temperature state in which there is no possibility of display difficulty, the value of t is increased, while when the liquid crystal panel 21 is in a low-temperature state in which there is a possibility of display difficulty, the value of t is decreased so as to enable display that has priority over the reduction of color break. Accordingly, it is possible to display an image even in a low-temperature state and efficiently reduce color break without narrowing the displayable temperature range.

Second Embodiment:

EXAMPLE 3

Figure 11:
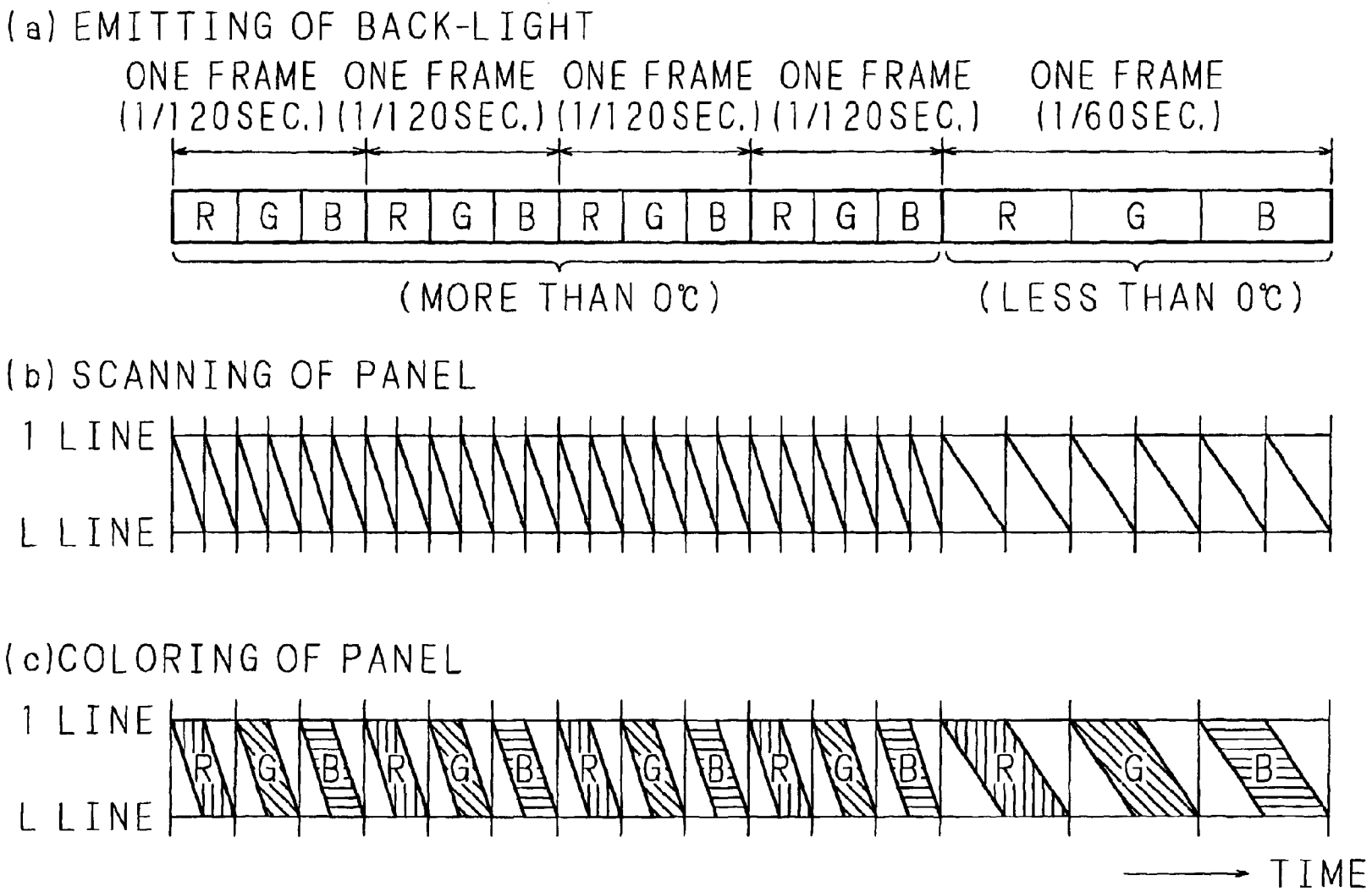
FIGS. 11(*a*), 11(*b*) and 11(*c*) show a time chart of display control according to Example 3.

FIGS. 11(*a*), 11(*b*) and 11(*c*) show the time chart of display control according to Example 3. In Example 3, a color image was displayed by changing the frame frequency to 120 hertz (t=120) when the temperature of the liquid crystal panel 21 was not lower than 0° C. or changing the frame frequency to 60 hertz (t=60) when the temperature of the liquid crystal panel 21 was lower than 0° C. As a result, it was possible to reduce color break due to the movement of the line of sight in a highly frequently used temperature range of not lower than 0° C. In this case, since the frame frequency was decreased at temperatures lower than 0° C., it was possible to realize a bright display even at temperatures lower than 0° C. and achieve −30° C. as the lower critical display temperature.

Second Embodiment:

EXAMPLE 4

Figure 12:
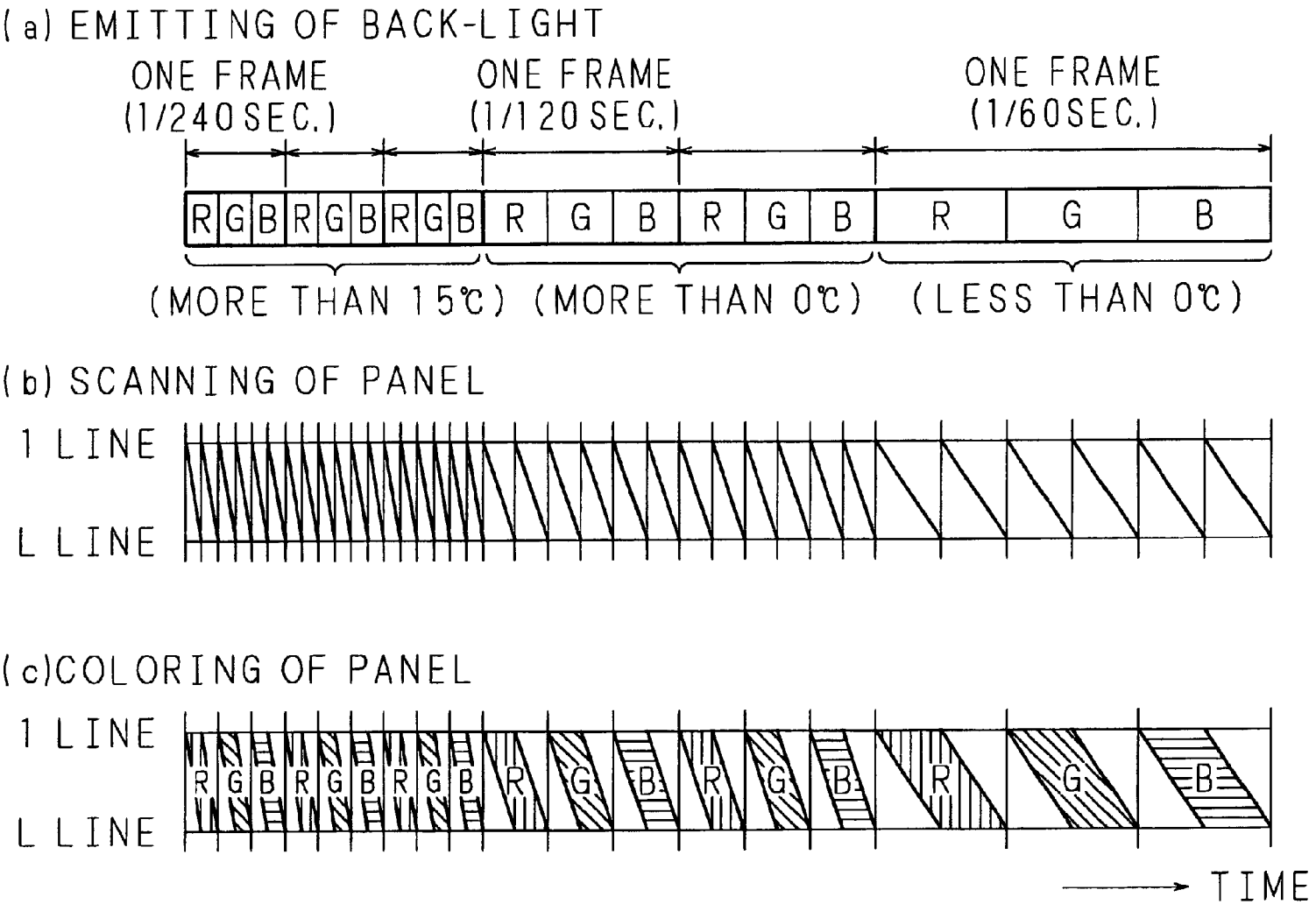
FIGS. 12(*a*), 12(*b*) and 12(*c*) show a time chart of display control according to Example 4.

FIGS. 12(*a*), 12(*b*) and 12(*c*) show the time chart of display control according to Example 4. In Example 4, a color image was displayed by changing the frame frequency to 240 hertz (t=240) when the temperature of the liquid crystal panel 21 was not lower than 15° C., changing the frame frequency to 120 hertz (t=120) when the temperature was not lower than 0° C. but was lower than 15° C., or changing the frame frequency to 60 hertz (t=60) when the temperature was lower than 0° C. As a result, it was possible to reduce color break due to the movement of the line of sight in a highly frequently used temperature range of not lower than 0° C. In particular, in the temperature range of not lower than 15° C., no color break was recognized. Moreover, since the frame frequency was decreased at temperatures lower than 0° C., it was possible to realize a bright display even at temperatures lower than 0° C. and achieve −30° C. as the lower critical display temperature.

Second Embodiment:

COMPARATIVE EXAMPLE 3

In Comparative Example 3, a color image was displayed by fixing the frame frequency at 60 hertz (t=60) irrespective of the temperature of the liquid crystal panel 21 (see FIGS. 8(*a*), 8(*b*) and 8(*c*)). As a result, color break due to the movement of the line of sight occurred. In particular, color break was noticeable in displaying a motion image. In this case, the lower critical display temperature was −30° C.

Second Embodiment:

COMPARATIVE EXAMPLE 4

In Comparative Example 4, a color image was displayed by fixing the frame frequency at 240 hertz (t=240) irrespective of the temperature of the liquid crystal panel 21 (see FIGS. 9(*a*), 9(*b*) and 9(*c*)). As a result, color break due to the movement of the line of sight was reduced. However, the lower critical display temperature that allows display increased extremely to 15° C., and sufficient brightness and display colors were not obtained at temperatures lower than 15° C. because of deterioration of the responsiveness of the liquid crystal.

It can be understood by comparing Examples 3, 4 and Comparative Examples 3, 4 as described above that the second embodiment can realize a reduction of color break without narrowing the displayable temperature range.

Moreover, while the above-described first embodiment has the structure where a circuit for discriminating motion picture data/still picture data is provided in the device, it is also possible to input information that indicates motion picture data or still picture data from an external device and change the frame number per second based on the information.

Furthermore, in the above-described second embodiment, while the frame number per second is changed based on the temperature of the liquid crystal panel 21, it is also possible to detect the ambient temperature of the liquid crystal display device and change the frame number per second based on the result of the detection.

Besides, while the above-described embodiments use an active type liquid crystal panel having a switching element made of a TFT for each pixel as a display element, it is also possible to implement the present invention with a simple matrix type liquid crystal panel in the same manner. Additionally, although the transmission type liquid crystal display element is used, it is also possible to implement the present invention with a reflection type or semi-transmission type liquid crystal display element in the same manner.

Moreover, while a ferroelectric liquid crystal material is used as the liquid crystal material, it is, of course, possible to apply the present invention in the same manner to a liquid crystal display device using an antiferroelectric liquid crystal material having the same spontaneous polarization or nematic liquid crystals if such a liquid crystal display device displays a color image by a field-sequential method.

Further, although the above explanation is given by illustrating the liquid crystal display devices as examples, the present invention is, of course, applicable in the same manner to other display device using a digital micro mirror device (DMD) or the like as the light switching element if the display device is designed to display a color image by a field-sequential method.

As described above, in the present invention, since the frame number per unit time (one second) is changed based on the type of image data to be displayed (motion picture data or still picture data), or based on the temperature of the light switching element or the surrounding environment, in displaying a color image by synchronizing the light-emission timing of a color of emitted light and the switching of the light switching element for controlling the intensity of light for display, it is possible to reduce color break in a display device employing a field-sequential method without considerably changing the power consumption and the displayable temperature range.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A display device employing a field-sequential method, comprising:

a light source having a plurality of colors of emitted light;

a light emission switching unit for sequentially switching the plurality of colors of emitted light of said light source within one frame;

a light switching element for controlling an intensity of light from said light source for display;

a control unit for controlling synchronization of a light-emission timing of each color of emitted light of said light source and a switching of said light switching element; and a frame number changing unit for changing a frame number per unit time; wherein said control unit controls the synchronization of the light emission timing and the switching in accordance with the frame number changed by said frame number changing unit, wherein said frame number changing unit comprises a discrimination circuit for judging whether display data is motion picture data or still picture data, and a changing circuit for changing the frame number per unit time based on a result of the judgement by said discrimination circuit.

2. The display device of claim 1, wherein when the display data is motion picture data, the frame number per unit time is increased compared with the frame number for still picture data.

3. The display device of claim 1, wherein said light switching element is a liquid crystal display element.

4. The display device of claim 3, wherein said liquid crystal display element includes a liquid crystal material having spontaneous polarization.

5. The display device of claim 3, wherein said liquid crystal display element comprises an active element corresponding to each of a plurality of liquid crystal pixels.

6. The display device of claim 4, wherein said liquid crystal display element comprises an active element corresponding to each of a plurality of liquid crystal pixels.

7. A field-sequential display method for displaying a color image by sequentially switching a plurality of colors of emitted light of a light source within one frame and by synchronizing a light-emission timing of each color of emitted light with a switching of a light switching element for controlling an intensity of light from said light source for display, comprising:

judging whether image data is motion picture data or still picture data; and changing a frame number per unit time based on a result of the judgement; and controlling the synchronization of the light-emission timing and the switching in accordance with the changed frame number.

* * * * *